US010337763B2

(12) United States Patent
Okamoto et al.

(10) Patent No.: US 10,337,763 B2
(45) Date of Patent: Jul. 2, 2019

(54) WATER HEATING SYSTEM

(71) Applicant: NORITZ CORPORATION, Hyogo (JP)

(72) Inventors: Shinichi Okamoto, Kobe (JP); Takao Muko, Kobe (JP)

(73) Assignee: NORITZ CORPORATION, Hyogo (JP)

( * ) Notice: Subject to any disclaimer, the term of this patent is extended or adjusted under 35 U.S.C. 154(b) by 0 days.

(21) Appl. No.: 15/901,487

(22) Filed: Feb. 21, 2018

(65) Prior Publication Data

US 2018/0252437 A1 Sep. 6, 2018

(30) Foreign Application Priority Data

Mar. 1, 2017 (JP) ..... 2017-038327

(51) Int. Cl.
*F22B 35/00* (2006.01)
*F24H 9/20* (2006.01)
*F23N 5/24* (2006.01)

(52) U.S. Cl.
CPC ..... *F24H 9/2042* (2013.01); *F23N 5/242* (2013.01); *F23N 2025/14* (2013.01); *F23N 2033/06* (2013.01); *F23N 2041/04* (2013.01)

(58) Field of Classification Search
CPC ..... F22B 35/008; F22B 33/00; F22B 35/00; F24D 2200/043; F24D 9/00; F24D 12/02; F23N 1/02; F24B 1/189; F01K 13/02; F24H 9/20
See application file for complete search history.

(56) References Cited

U.S. PATENT DOCUMENTS

| | | | | |
|---|---|---|---|---|
| 8,235,707 | B2 * | 8/2012 | Kim | F24H 9/2042 126/101 |
| 8,868,251 | B2 * | 10/2014 | Hatada | F24H 1/10 219/200 |
| 9,388,977 | B2 * | 7/2016 | Yamada | F22B 35/008 |
| 9,518,762 | B2 * | 12/2016 | Hatada | F24H 1/10 |
| 9,951,970 | B2 * | 4/2018 | Shimada | F24H 9/2035 |
| 9,970,682 | B2 * | 5/2018 | Okada | F24H 9/2035 |
| 10,018,376 | B2 * | 7/2018 | Sato | F24H 1/145 |
| 10,030,866 | B2 * | 7/2018 | Hyodo | F22B 35/008 |

FOREIGN PATENT DOCUMENTS

| | | | |
|---|---|---|---|
| JP | 2001132940 | A * | 5/2001 |
| JP | 3597603 | B2 | 12/2004 |

* cited by examiner

*Primary Examiner* — Gregory A Wilson
(74) *Attorney, Agent, or Firm* — Studebaker & Brackett PC

(57) ABSTRACT

A plurality of water heaters are connected in parallel with respect to a hot water supply path, and each of the plurality of water heaters has an exhaust path connected to an exhaust path assembly. Each of a plurality of sensing units is configured to be shifted from an electrically conducting state to an electrically non-conducting state when each of the plurality of sensing units senses an abnormal condition about air supply or exhaust. A series circuit of the plurality of sensing units is electrically connected in series to a resistance element between the power supply line and the ground line. The controller is configured to monitor an abnormal condition about air supply or exhaust based on a voltage on a node between the series circuit and the resistance element.

5 Claims, 11 Drawing Sheets

WATER HEATING SYSTEM

BACKGROUND OF THE INVENTION

Field of the Invention

The present invention relates to a water heating system and more particularly to a water heating system in which a plurality of water heaters are linked to one another.

Description of the Background Art

A water heating system in which a plurality of water heaters are linked in parallel (which is hereinafter also referred to as a linked water heating system) has been known. In such a water heating system, hot water can be supplied at a high flow rate by connecting a hot water supply control unit of each water heater to a controller and collectively controlling all water heaters in accordance with a control signal from the controller to each hot water supply control unit.

As one of linked water heating systems, a so-called common vent-type water heating system is known, in which an exhaust duct of each water heater is connected to a common exhaust duct assembly and combustion exhaust generated in each water heater is collected in the exhaust duct assembly and introduced to the outside.

In the common vent-type linked water heating system, it is important to prevent a backflow of the exhaust from the exhaust duct assembly to other water heaters in a non-combusting state while only at least one water heater is in a combusting state. Thus, also in a water heater in the non-combusting state, a fan for facilitating emission of exhaust from this water heater is rotated so as to prevent a backflow of the exhaust to this water heater in the non-combusting state. Furthermore, an external fan is installed inside the exhaust duct assembly for facilitating emission of the exhaust to the outdoors.

In addition, when an abnormal condition of exhaust such as a backflow of the exhaust occurs due to a failure or the like in these fans, it is necessary to immediately sense the abnormal condition of the exhaust and stop combustion. Accordingly, the conventional common vent-type linked water heating system employs a configuration in which a plurality of elements for sensing an abnormal condition of exhaust are combined and installed. Examples of such a sensing element may be a CO sensor, a wind pressure switch and a wind speed switch, for example, disclosed in Japanese Patent No. 3597603.

SUMMARY OF THE INVENTION

In the conventional linked water heating system, a controller includes a plurality of signal input units (terminal blocks) for receiving sensing signals from a plurality of sensing elements. Thus, when the number of sensing elements is increased, the accuracy in sensing an abnormal condition of exhaust is increased, but there is also a problem that the controller is increased in size and complexity. Furthermore, the type and the number of sensing elements may be different depending on the site where the linked water heating system is installed. Accordingly, in order to be compatible with linked water heating systems installed in various sites, the controller needs to include many signal input units, which leads to concerns that the controller may be further increased in size and complexity, and the number of components may be increased. Furthermore, there are still rooms for improvement, for example, in that there may exist a signal input unit that is not used depending on the site, which leads to waste.

The present invention has been made to solve the above-described problems. An object of the present invention is to provide a water heating system by which outputs from a plurality of sensing units for sensing an abnormal condition of air supply or exhaust can be monitored in a simple configuration.

According to an aspect of the present invention, a water heating system is provided as a water heating system of a combustion heating type of a forced exhaust mode, and includes a plurality of water heaters, a controller, and a plurality of sensing units. The plurality of water heaters are connected in parallel with respect to a hot water supply path, the plurality of water heaters each having an exhaust path connected to an exhaust path assembly. The controller is configured to collectively control the plurality of water heaters. Each of the plurality of sensing units is configured to be shifted from an electrically conducting state to an electrically non-conducting state when each of the plurality of sensing units senses an abnormal condition about air supply or exhaust. The plurality of sensing units are electrically connected in series between a power supply line and a ground line. A series circuit of the plurality of sensing units is electrically connected in series to a resistance element between the power supply line and the ground line. The controller is configured to monitor the abnormal condition about air supply or exhaust based on a voltage on a node between the series circuit and the resistance element.

In the configuration as described above, when an abnormal condition about air supply or exhaust is sensed in at least one of the plurality of sensing units, the series circuit of the plurality of sensing units is cut off. Thus, the voltage on the node between the series circuit and the resistance element changes from the voltage in the normal condition. Therefore, the controller is provided with only one signal input unit (terminal block) configured to monitor the voltage on the node, so that the outputs from the plurality of sensing units can be monitored. In other words, it becomes possible to provide a water heating system, by which outputs from a plurality of sensing units for sensing an abnormal condition of air supply or exhaust can be monitored in a simple configuration.

Preferably, the plurality of sensing units include a first sensing unit and a second sensing unit. The first sensing unit is configured to receive an output from a CO alarm unit for sensing a CO concentration in an indoor space in which the plurality of water heaters are housed. The second sensing unit is configured to receive an output from a first wind pressure switch for sensing a decrease in wind pressure inside the exhaust path assembly.

In the configuration as described above, the controller can monitor the outputs from the CO alarm unit and the wind pressure switch by a single signal input unit. Accordingly, in a simple configuration, the controller can accurately sense a backflow of the exhaust from the exhaust path assembly.

Preferably, the plurality of sensing units further include a third sensing unit. The third sensing unit is a high limit switch configured to sense an abnormal temperature inside an air supply path of each of the plurality of water heaters.

In the configuration as described above, the controller can monitor the outputs from the CO alarm unit, the wind pressure switch and the high limit switch by a single signal input unit. Accordingly, in a simple configuration, the controller can accurately sense a backflow of the exhaust from the exhaust path assembly.

Preferably, the plurality of sensing units further include a fourth sensing unit. The fourth sensing unit is configured to receive an output from a second wind pressure switch for sensing wind pressure of air supplied into the indoor space in which the plurality of water heaters are housed.

In the configuration as described above, by a single signal input unit, the controller can monitor the outputs from the CO alarm unit, the first wind pressure switch and the second wind pressure switch. The controller can determine based on the output from the second wind pressure switch whether air supplied into the indoor space is sufficient or not. When air supplied into the indoor space is insufficient, incomplete combustion occurs in each of the water heaters, which may lead to deterioration in exhaust properties. Thus, in a simple configuration, the controller can accurately sense: a back-flow of the exhaust from the exhaust path assembly; and deterioration in exhaust properties.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
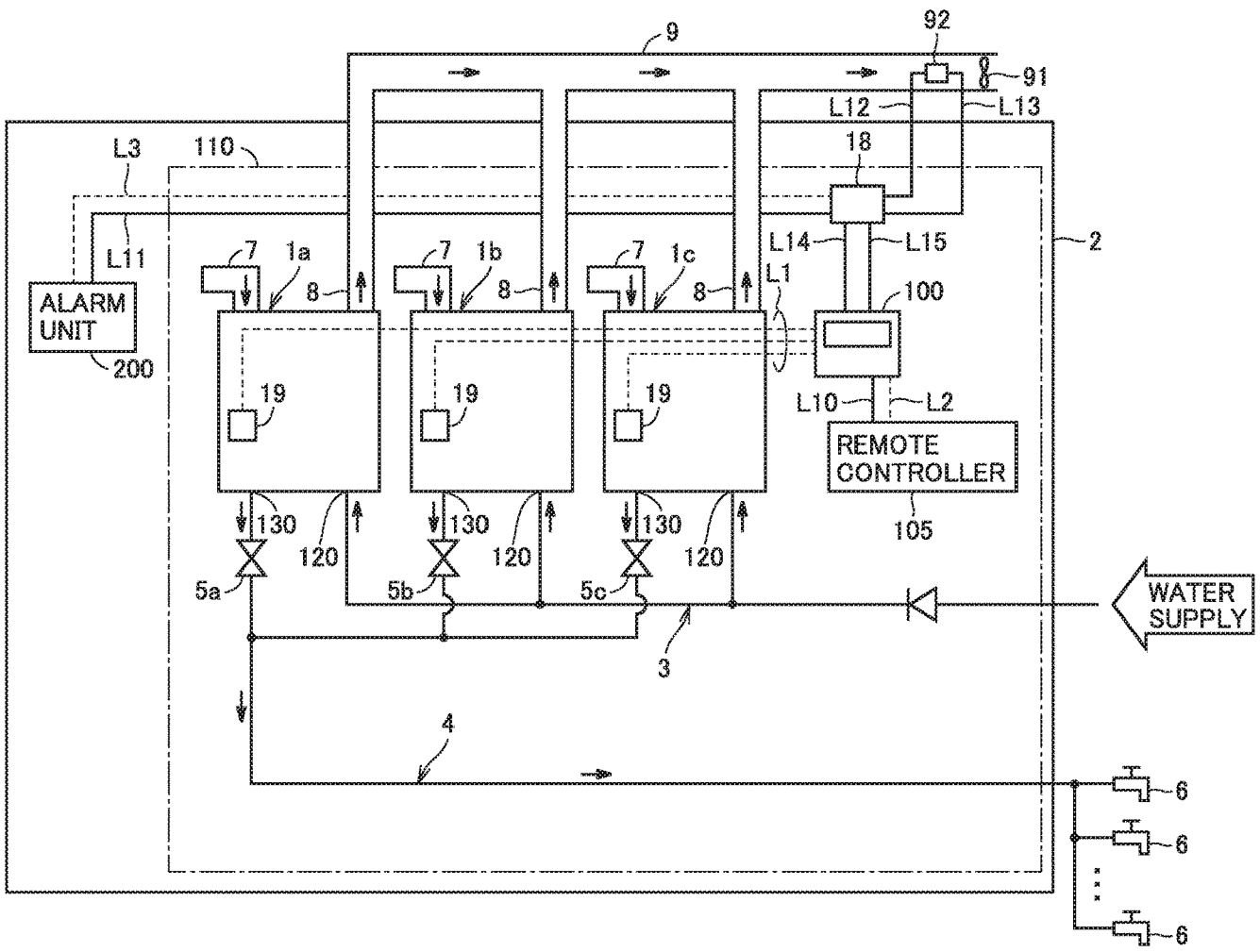
FIG. 1 is a configuration diagram of a water heating system according to the first embodiment.

The embodiments of the present invention will be hereinafter described in detail with reference to the accompanying drawings. In the following description, the same or corresponding components are designated by the same reference characters, and description thereof will not be basically repeated.

First Embodiment

In the first embodiment of the present invention, a water heating system of a combustion heating type of a forced exhaust mode, which is implemented by linking three water heaters in parallel, will initially be described. Each water heater of a water heating system 110 according to the present first embodiment may be a latent heat recovery type water heater which can recover latent heat of combustion gas. The number of water heaters implementing water heating system 110 is not limited to three, and two or four or more water heaters are applicable.

(Configuration of Water Heating System)

FIG. 1 is a diagram showing an overall configuration of water heating system 110 according to the first embodiment of the present invention. Water heating system 110 according to the first embodiment is installed inside a room 2.

Referring to FIG. 1, water heating system 110 includes water heaters 1*a*, 1*b* and 1*c*, a water supply pipe 3 for supplying water to each water heater, a hot water supply pipe 4 for sending water and/or hot water from each water heater, valves 5*a*, 5*b* and 5*c*, a controller 100, a sensing device 18, and a remote controller 105. Water heaters 1*a*, 1*b* and 1*c* are hereinafter collectively referred to as water heater 1.

Water heaters 1*a*, 1*b* and 1*c* are connected in parallel with respect to water supply pipe 3 which receives supply of water from tap water or the like. Water supply pipe 3 supplies water to a water inlet 120 of each water heater. Water heaters 1*a*, 1*b* and 1*c* are connected in parallel with respect to hot water supply pipe 4 serving as a hot water supply path. Water heaters 1*a*, 1*b* and 1*c* are linked to one another through water supply pipe 3 and hot water supply pipe 4. Hot water supply pipe 4 is provided with at least one hot water supply faucet (hot water supply tap) 6.

Valves 5*a*, 5*b* and 5*c* are connected between respective hot water outlets 130 of water heaters 1*a*, 1*b*, and 1*c* and hot water supply pipe 4. Valve 5 is implemented, for example, by an electromagnetic on-off valve. Valve 5 may be built in water heater 1. Valve 5 does not have to be provided if a water amount servo valve 132 and a bypass flow rate regulation valve 141 (each of which will be described later) of water heater 1 have a full closing function.

Controller 100 collectively controls water heaters 1*a*, 1*b*, and 1*c*. Controller 100 controls opening and closing of each of valves 5*a*, 5*b*, and 5*c*. Controller 100 and a hot water supply control unit 19 (described later) of each water heater 1 are connected to each other through a communication line L1. Controller 100 bidirectionally communicates with hot water supply control unit 19 through communication line L1. Controller 100 has each water heater 1 perform such an operation as activation of combustion and stop of combustion by transmitting a command used for control of the number of operating water heaters (which will be described later) to hot water supply control unit 19 of each water heater 1. Sensing device 18 is connected to controller 100 through lines L14 and L15. Remote controller 105 is further connected to controller 100 through a communication line L2 and a power line L10.

Remote controller 105 is used in order for a user to issue various commands to controller 100. Various commands include a command to turn on and off the operation of water heating system 110 and a command to set a temperature of hot water. Remote controller 105 is used to notify a user about the state of operation of water heating system 110.

As shown in FIG. 1, an alarm unit 200 is installed inside room 2 in which water heating system 110 is housed. Alarm unit 200 is configured to sense the carbon monoxide (CO) concentration inside room 2 and output an alarm based on the sensed CO concentration. When the exhaust from water heating system 110 flows back into room 2, alarm unit 200 outputs an alarm based on the CO contained in the exhaust.

As shown in FIG. 1, an exhaust duct assembly 9 is installed on the outside of room 2 in which water heating system 110 is installed. Exhaust duct assembly 9 is configured to be connected to exhaust ducts 8 of respective water heaters 1 so as to collectively guide exhausts from water heaters 1*a*, 1*b*, and 1*c* to the outside. A downstream end of exhaust duct assembly 9 communicates with the outdoors.

An external fan 91 and a wind pressure switch 92 are installed inside exhaust duct assembly 9. As controller 100 causes external fan 91 to rotate, the exhaust in exhaust duct assembly 9 is emitted to the outdoors. Wind pressure switch 92 is configured to be shifted from an electrically conducting state (ON) to an electrically non-conducting state (OFF) when the wind pressure of the exhaust inside exhaust duct assembly 9 shows a prescribed value or less.

Sensing device 18 is connected to alarm unit 200 through communication line L3 and power line L11. Sensing device 18 is connected to wind pressure switch 92 through power lines L12 and L13. Sensing device 18 monitors the exhaust for an abnormal condition based on the outputs from alarm unit 200 and wind pressure switch 92. Sensing device 18 outputs a monitored result to controller 100. The detailed configuration of sensing device 18 will be described later.

FIG. 1 shows an example of the configuration in which controller 100 and sensing device 18 are installed outside water heaters 1*a*, 1*b* and 1*c*, but at least one of controller 100 and sensing device 18 may be installed inside one of water heaters 1*a*, 1*b* and 1*c*.

Figure 2:
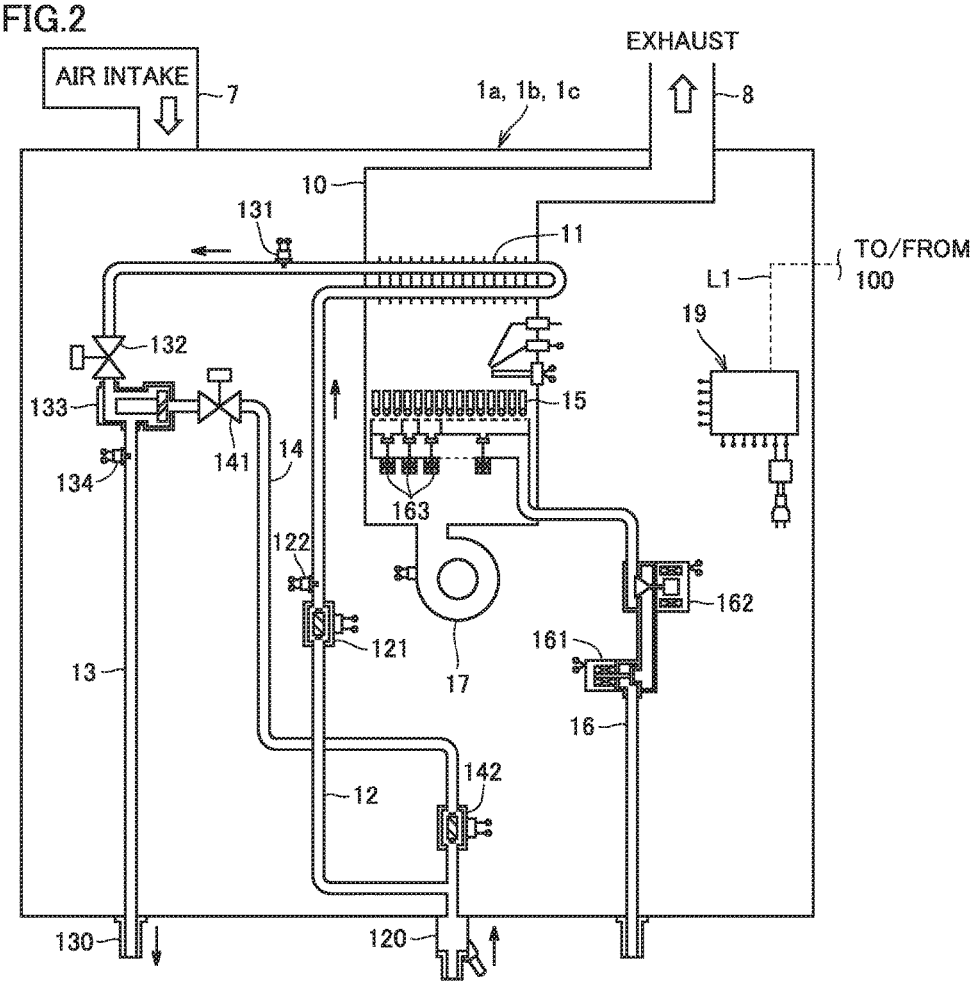
FIG. 2 is a configuration diagram of a water heater according to the first embodiment.

The configuration of each water heater will now be described with reference to FIG. 2. FIG. 2 is a diagram showing a detailed configuration of water heater 1 shown in FIG. 1. Referring to FIG. 2, water heater 1 includes a water entry pipe 12, a combustion unit 10, a gas supply pipe 16, a fan 17, a hot water delivery pipe 13, a bypass pipe 14, an air supply duct 7, an exhaust duct 8, and hot water supply control unit 19.

Water entry pipe 12 is used for sending water from water inlet 120 to combustion unit 10. An incoming water flow rate sensor 121 and an incoming water temperature sensor 122 which measure a flow rate and a temperature of incoming water, respectively, are connected to water entry pipe 12.

Combustion unit 10 includes a burner 15 and a heat exchanger 11. Burner 15 corresponds to a combustion portion serving to burn a fuel during a hot water supply operation. Heat exchanger 11 exchanges heat between a combustion exhaust generated as a result of a combustion operation by burner 15 and water and/or hot water supplied through water entry pipe 12. Water and/or hot water which flows through heat transfer pipes in heat exchanger 11 is heated.

Gas supply pipe 16 supplies fuel gas to burner 15. A main gas electromagnetic valve 161 and a gas proportional valve 162 for regulating an amount of supply of gas to burner 15 as well as a plurality of combustion control valves 163 are connected to gas supply pipe 16.

Fan 17 is activated during combustion by burner 15 and sends air for combustion to burner 15. Fan 17 emits exhaust produced as a result of combustion by burner 15 to exhaust duct 8.

Hot water delivery pipe 13 is used for sending water and/or hot water heated by heat exchanger 11 to hot water outlet 130. An outgoing hot water temperature sensor 131 which measures a temperature of water and/or hot water output from heat exchanger 11, water amount servo valve 132, a water and/or hot water mixing valve 133, a hot water supply temperature sensor 134 which measures a temperature of water and/or hot water sent through hot water outlet 130, and bypass flow rate regulation valve 141 are connected to hot water delivery pipe 13.

Bypass pipe 14 is used to mix water with water and/or hot water sent from heat exchanger 11. A bypass flow rate sensor 142 is provided in bypass pipe 14.

Air supply duct 7 is used to introduce air inside room 2 into water heater 1. Exhaust duct 8 is used to emit the exhaust generated in water heater 1 to exhaust duct assembly 9.

Hot water supply control unit 19 bidirectionally communicates with controller 100 through communication line L1. Hot water supply control unit 19 controls each portion in water heater 1 including burner 15 and fan 17 in response to a control command given from controller 100 through communication line L1. The control command includes a command for instructing start and stop of a hot water supply operation (a start command and a stop command) and a command for instructing a condition for operation (for example, a target temperature of hot water supply). Hot water supply control unit 19 transmits the state of operation of water heater 1 to controller 100. Control of water heater 1 by hot water supply control unit 19 will be described later.

Although FIG. 1 shows communication lines L1 to L3 as wires, communication between controller 100 and each hot water supply control unit 19, communication between controller 100 and remote controller 105, and communication between controller 100 and alarm unit 200 may be wireless.

(Control in Water Heating System)

Control in water heating system 110 according to the first embodiment will now be described.

In water heating system 110 according to the first embodiment, controller 100 controls the number of operating water heaters and an operation to monitor for an abnormal condition in coordination with hot water supply control unit 19 of each water heater 1.

Control of the number of operating water heaters refers to control for determining the number of operating water heaters 1 in accordance with a load and for setting unnecessary water heater 1 to an inactive state based on the determination. A control technique well known for the linked water heating system can be applied to control of the number of operating water heaters. The number of operating water heaters is controlled during a hot water supply operation in water heating system 110. The hot water supply operation is turned on by an operation of a switch in remote controller 105 (switch ON and OFF of the operation) and started when water supply to water heater 1 in a quantity equal to or greater than a prescribed minimum operation quantity of working water is detected.

When a desired temperature of hot water supply is set in remote controller 105 and a hot water supply operation of water heating system 110 is started, controller 100 determines the number of water heaters 1 which perform the hot water supply operation (which are hereinafter also referred to as combusting water heaters) in accordance with a required amount of hot water supply, and selects combusting water heaters based on the determined number of water heaters. Controller 100 transmits a start command for instructing hot water supply control unit 19 of the combusting water heater to start the hot water supply operation.

Controller 100 further switches valve 5 corresponding to the combusting water heater from a closed state to an opened state. Water and/or hot water heated in the combustion operation by the combusting water heater is thus supplied from hot water supply faucet 6. Valve 5 may be controlled by hot water supply control unit 19 to be opened and closed in response to a start command and a stop command from controller 100 for each water heater 1.

Controller 100 transmits a temperature of hot water supply set in remote controller 105 as a target temperature of hot water supply to hot water supply control unit 19 of the combusting water heater. Hot water supply control unit 19 of the combusting water heater thus controls an amount of combustion by burner 15 so as to set a temperature of outgoing hot water to a target temperature of hot water supply, and also causes fan 17 to rotate at a rotation speed corresponding to the amount of combustion.

When the total sum of amounts of outgoing hot water from all combusting water heaters is close to the total sum of upper limits of capacities of all combusting water heaters, controller 100 instructs one of water heaters 1 of which hot water supply operation is stopped (which are hereinafter also referred to as non-combusting water heaters) to start the hot water supply operation. Controller 100 transmits a start command and a target temperature of hot water supply to hot water supply control unit 19 of the non-combusting water heater, and also switches valve 5 corresponding to the non-combusting water heater from the closed state to the opened state.

When the amount of supply of hot water decreases while two or more combusting water heaters are operating, controller 100 transmits a stop command to hot water supply control unit 19 of one combusting water heater, and switches valve 5 corresponding to the combusting water heater from the opened state to the closed state.

While the number of operating water heaters is being controlled as described above, controller 100 also causes fan 17 of a non-combusting water heater to rotate. Specifically, controller 100 issues a command to rotate only fan 17 together with a stop command to hot water supply control unit 19 of water heater 1 selected as a non-combusting water heater. Thereby, the pressure inside the non-combusting water heater can be adjusted so as not to be lower than the pressure inside exhaust duct assembly 9.

By controlling fan 17 as described above, and by facilitating emission of exhaust by external fan 91 in exhaust duct assembly 9 as previously described, a backflow from exhaust duct assembly 9 is prevented.

In such a configuration, however, when an abnormal condition occurs in operations of fan 17 and external fan 91, an abnormal condition of exhaust may occur. Specifically, the exhaust from exhaust duct assembly 9 may flow back into water heater 1 in which an abnormal condition occurs. There is a possibility that the exhaust flowing back into water heater 1 may flow through air supply duct 7 into room 2.

Thus, in water heating system 110 according to the present first embodiment, in order to immediately sense an abnormal condition of exhaust when such an abnormal condition occurs, a plurality of sensing elements such as alarm unit 200 and wind pressure switch 92 that is disposed inside exhaust duct assembly 9 are used. Then, when at least one of the sensing elements senses such an abnormal condition, combustion in the combusting water heater is stopped.

However, in the configuration as described above, when the number of sensing elements is increased, the accuracy in sensing an abnormal condition of exhaust is increased, but the number of signal input units (terminal blocks) for receiving an output from each sensing element in controller 100 is increased. Consequently, there occurs a problem that the controller is increased in size and complexity.

Figure 3:
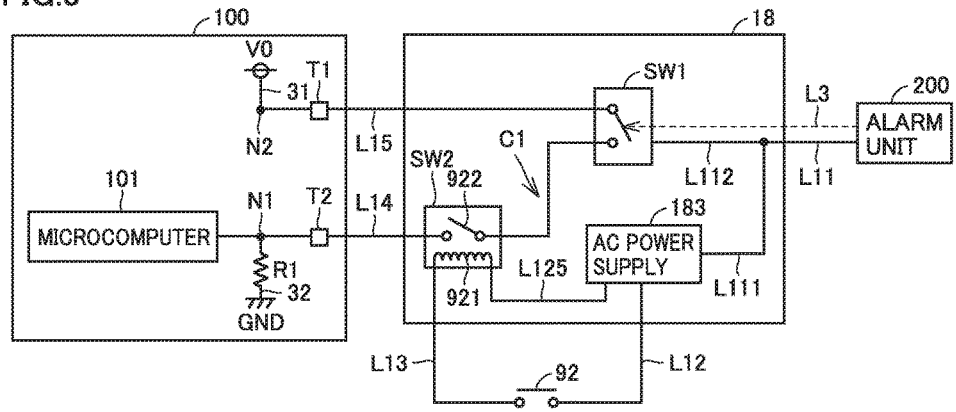
FIG. 3 is an electric circuit diagram of a sensing device according to the first embodiment.

Thus, in water heating system 110 according to the present first embodiment, sensing device 18 is configured as shown in FIG. 3 such that controller 100 can monitor outputs from alarm unit 200 and wind pressure switch 92 by a single signal input unit.

FIG. 3 is an electric circuit diagram of a sensing device according to the first embodiment. Referring to FIG. 3, sensing device 18 includes a switch SW1, a switch SW2 and an AC power supply 183.

Switch SW1 is connected to alarm unit 200 through communication line L3. Switch SW1 is in an electrically conducting state in the normal condition, and is configured to be shifted into a non-conducting state when this switch SW1 receives through communication line L3 a signal showing that alarm unit 200 has sensed CO. Switch SW1 corresponds to the "first sensing unit".

Switch SW2 includes a coil 921 and a contact 922. Coil 921 is electrically connected in series to wind pressure switch 92 between power line L125 and power line L12. Wind pressure switch 92 is in an electrically conducting state in the normal condition, and is configured to be brought into a non-conducting state when the wind pressure inside exhaust duct assembly 9 becomes equal to or less than a prescribed value. When wind pressure switch 92 is in an electrically conducting state, a current is supplied from AC power supply 183 through power lines L12, L13, L125 and wind pressure switch 92 to coil 921. Contact 922 is closed by exciting coil 921. In other words, when wind pressure switch 92 is in an electrically conducting state, switch SW2 is also brought into an electrically conducting state.

On the other hand, when wind pressure switch 92 is in an electrically non-conducting state, a current does not flow through a circuit formed of power lines L12, L13 and L125, with the result that a current does not flow also through coil 921. Since coil 921 is not excited at this time, contact 922 is opened. In other words, when wind pressure switch 92 is in an electrically non-conducting state, switch SW2 is also brought into an electrically non-conducting state. Switch SW2 corresponds to the "second sensing unit".

AC power supply 183 supplies electric power to alarm unit 200, switches SW1 and SW2, and wind pressure switch 92 through power lines L11 to L13, L111, L112, and L125.

As shown in FIG. 3, switch SW1 and switch SW2 are electrically connected in series between power supply line 31 and ground line 32. A series circuit C1 of switch SW1 and switch SW2 (corresponding to a "series circuit of sensing units") is further electrically connected in series to resistance element R1 between power supply line 31 and ground line 32. A node N2 between series circuit C1 and power supply line 31 is electrically connected to a terminal T1 of controller 100 through line L15. A node N1 between series circuit C1 and ground line 32 is electrically connected to a terminal T2 of controller 100 through line L14. Terminal T2 is connected to a microcomputer 101. Microcomputer 101 can detect a voltage V1 on node N1, which is to be input into terminal T2.

Figure 4:
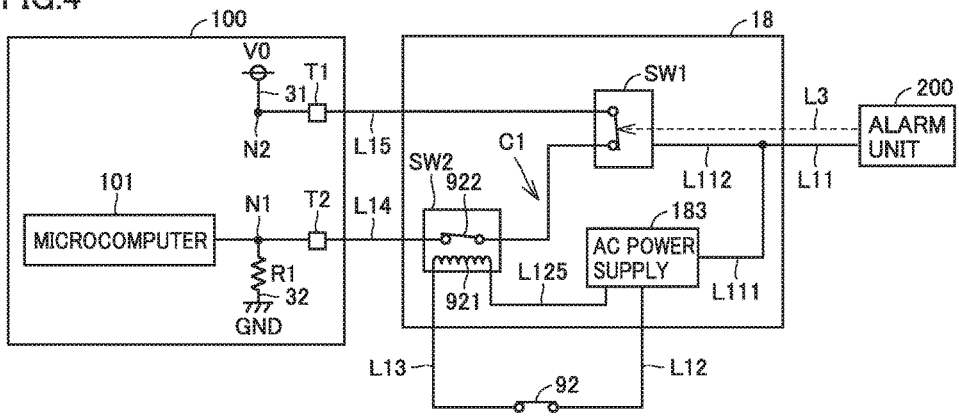
FIG. 4 is an electric circuit diagram of the sensing device in a normal condition.

Then, the operation of sensing device 18 will be hereinafter described. FIG. 4 shows an electric circuit diagram of the sensing device in a normal condition in which exhaust is normally conducted. As described above, in the normal condition, each of switches SW1 and SW2 is in an electrically conducting state. Thus, series circuit C1 is in a conducting state. Accordingly, a current flows through series circuit C1 and resistance element R1.

In this case, assuming that the voltage on power supply line 31 is defined as V0, the resistance of resistance element R1 is defined as R1, the resistance of series circuit C1 is defined as R2, and voltage V1 on node N1 is defined as V1*n*, V1*n* is represented by the following equation (1).

$$V1n=\{R1/(R1+R2)\}\times V0 \quad (1)$$

Figure 5:
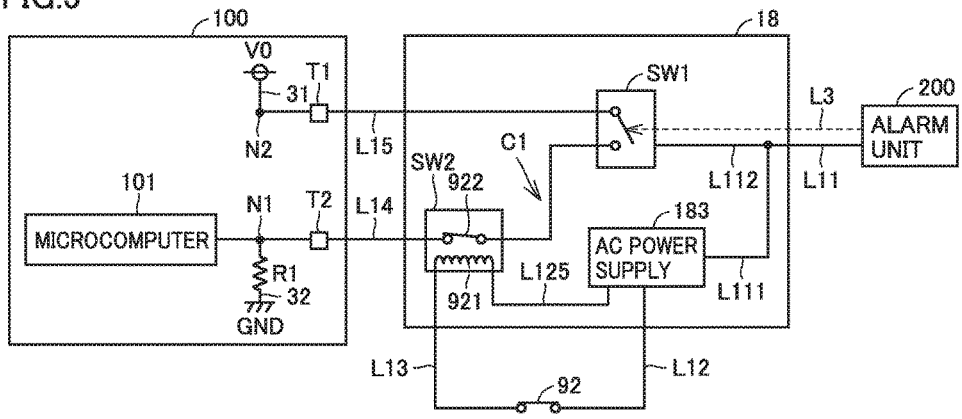
FIG. 5 is an electric circuit diagram of the sensing device at the time when CO is sensed.
Figure 6:
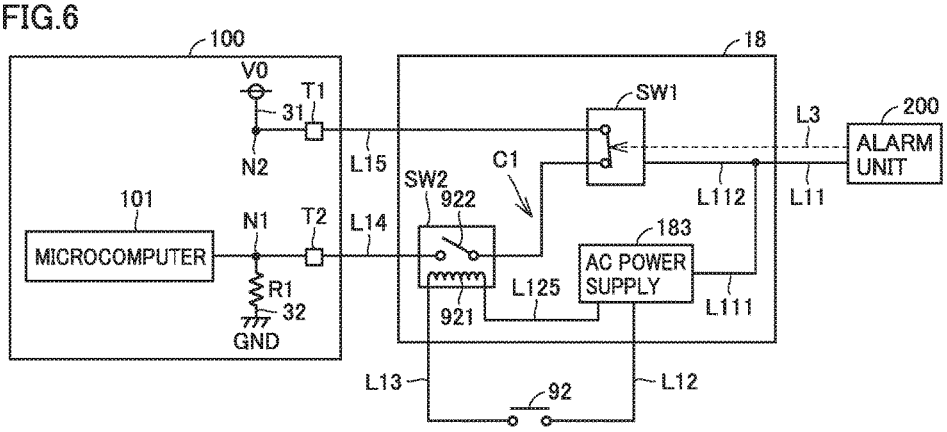
FIG. 6 is an electric circuit diagram of the sensing device at the time when it senses the state where a wind pressure becomes equal to or less than a prescribed value in an exhaust duct assembly.

FIG. 5 is an electric circuit diagram of the sensing device at the time when alarm unit 200 senses C0. FIG. 6 is an electric circuit diagram of the sensing device at the time when it senses the state where a wind pressure becomes equal to or less than a prescribed value in the exhaust duct assembly. As shown in FIGS. 5 and 6, when an abnormal condition of exhaust is sensed by one of alarm unit 200 and wind pressure switch 92, one of switches SW1 and SW2 is shifted from an electrically conducting state to an electrically non-conducting state. Consequently, series circuit C1 is cut off. Also when an abnormal condition of exhaust is sensed both in alarm unit 200 and wind pressure switch 92, series circuit C1 is cut off. Assuming that voltage V1 on node N1 at this time is defined as V1*d*, the value of V1*d* is 0.

Thus, microcomputer 101 can determine that exhaust is normally conducted when voltage V1 on node N1 input into terminal T2 is V1*n*. On the other hand, when voltage V1 is V1*d*, microcomputer 101 can determine that an abnormal condition of exhaust has been sensed. In other words, by single terminal T2, microcomputer 101 can monitor outputs from the first and second sensing units each for sensing an abnormal condition of exhaust.

In FIGS. 3 to 6, resistance element R1 is connected to node N1 between series circuit C1 and ground line 32, but resistance element R1 may be connected to node N2 between power supply line 31 and series circuit C1. In this case, microcomputer 101 is connected to terminal T1 of controller 100. Microcomputer 101 can sense an abnormal condition about exhaust based on voltage V2 on node N2, which is input into terminal T1. In this case, assuming that voltage V2 on node N2 in a normal condition is defined as V2*n* and voltage V2 on node N2 at the time when an abnormal condition of exhaust is sensed is defined as V2*d*, V2*n* and V2*d* are represented by the following equations (2) and (3), respectively.

$$V2n=\{R2/(R1+R2)\}\times V0 \quad (2)$$

$$V2d=V0 \quad (3)$$

In other words, when voltage V2 on node N2 that is input into terminal T1 is V2*n*, microcomputer 101 can determine that exhaust is normally conducted. Also, when voltage V2 is V2*d*, microcomputer 101 can determine that an abnormal condition of exhaust has been sensed. In other words, by single terminal T1, microcomputer 101 can monitor outputs from a plurality of sensing units each for sensing an abnormal condition of exhaust.

Figure 7:
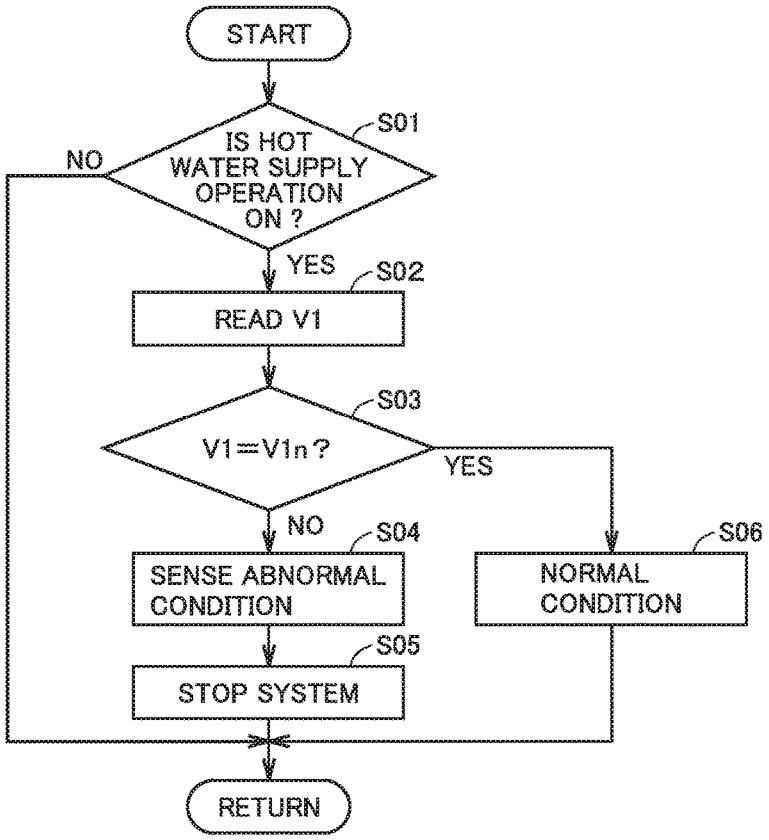
FIG. 7 is a flowchart of control processing for the sensing device according to the first embodiment.

FIG. 7 is a flowchart of control processing for the sensing device according to the first embodiment. The control processing shown in FIG. 7 is repeatedly performed at prescribed time intervals by microcomputer 101 of controller 100.

Referring to FIG. 7, in step S01, microcomputer 101 determines whether the hot water supply operation is ON or not. When the hot water supply operation is ON in step S01 (YES in S01), microcomputer 101 advances the process to step S02, and reads voltage V1 on node N1.

On the other hand, when the hot water supply operation is OFF in step S01 (NO in S01), microcomputer 101 skips the subsequent steps S02 to S06, and returns the process to a main routine.

In step S03 subsequent to step S02, microcomputer 101 determines whether voltage V1 is equal to voltage V1*n* or not. When V1=V1*n* in step S03 (YES in S03), microcomputer 101 determines in step S06 that exhaust is normally conducted, and then, returns the process to a main routine.

On the other hand, when it is determined in steps S03 that V1 is not equal to V1*n*, that is, when V1=0 (NO in S03), microcomputer 101 determines in step S04 that an abnormal condition of exhaust has been sensed. In step S05, microcomputer 101 stops combustion in the combusting water heater, thereby stopping the water heating system.

In this way, according to the present first embodiment, a plurality of sensing units are connected in series between the power supply line and the ground line, and each of the plurality of sensing units is configured to be shifted from an electrically conducting state to an electrically non-conducting state when an abnormal condition of air supply or exhaust is sensed. Furthermore, a resistance element is provided between the series circuit of sensing units and the power supply line or the ground line. The controller monitors the voltage on the node between the series circuit and the resistance element, so that it can sense an abnormal condition about exhaust. In other words, by a single terminal connected to this node, the controller can monitor the outputs from the plurality of sensing units. Specifically, the outputs from a plurality of sensing units for sensing an abnormal condition of air supply or exhaust can be monitored in a simple configuration.

Second Embodiment

Figure 8:
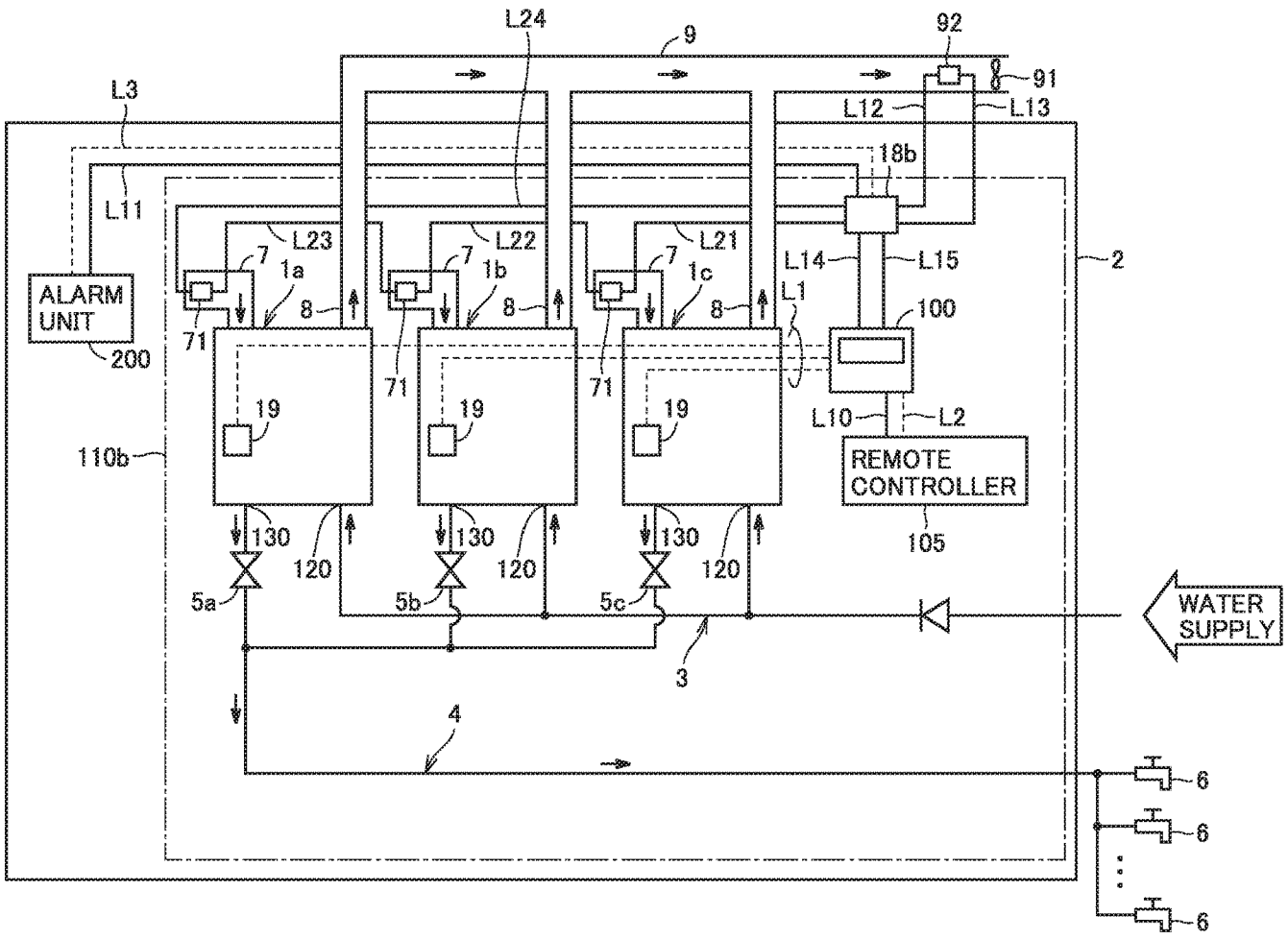
FIG. 8 is a configuration diagram of a water heating system according to the second embodiment.
Figure 9:
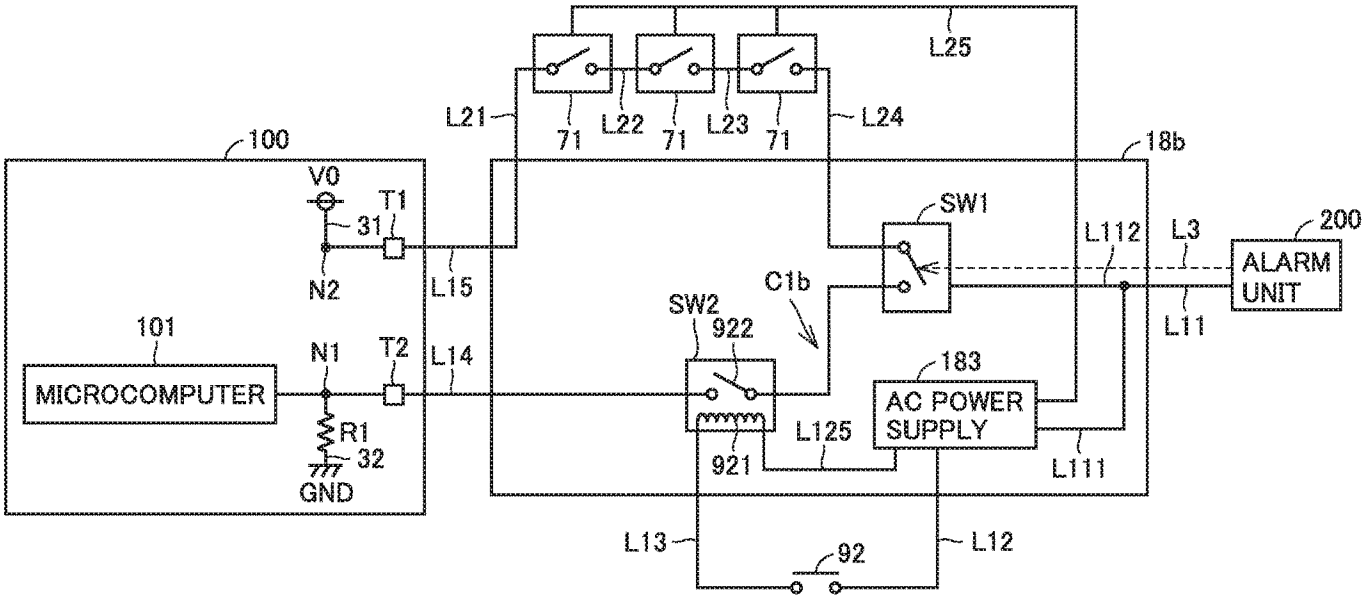
FIG. 9 is an electric circuit diagram of a sensing device according to the second embodiment.

FIGS. 8 and 9 are a configuration diagram of a water heating system according to the second embodiment and an electric circuit diagram of a sensing device according to the second embodiment, respectively. Referring to FIGS. 8 and 9, a water heating system 110*b* and a sensing device 18*b* according to the second embodiment are different from water heating system 110 and sensing device 18 according to the first embodiment in that a high limit switch 71 is provided in air supply duct 7 of each water heater 1.

High limit switch 71 is configured to be shifted to a non-conducting state when the temperature inside air supply duct 7 becomes equal to or greater than a prescribed threshold value. Accordingly, if the temperature inside air supply duct 7 becomes equal to or greater than a prescribed threshold value when a backflow of the exhaust occurs in air supply duct 7, high limit switch 71 is shifted from an electrically conducting state to an electrically non-conducting state. High limit switch 71 corresponds to the "third sensing unit".

High limit switch 71 of each water heater 1 is connected to sensing device 18*b*. In FIG. 9, high limit switch 71 of each water heater 1 is electrically connected in series between power supply line 31 and switch SW1 through lines L21 to L24. Furthermore, each high limit switch 71 is connected to AC power supply 183 through power line L25, and receives electric power supplied from AC power supply 183.

A plurality of high limit switches 71, switch SW1 and switch SW2 constitute a series circuit C1*b*. Since series circuit C1*b* is in a conducting state in a normal condition, a current can be caused to flow through the path in which series circuit C1*b* is placed. On the other hand, series circuit C1*b* is cut off when a backflow of the exhaust is sensed by at least one of the plurality of high limit switches 71, alarm unit 200 and wind pressure switch 92, and then, the current in the above-described path is interrupted.

Assuming that the resistance of series circuit C1*b* is defined as a resistance R2*b* and voltage V1*b* on node N1 in a normal condition is defined as V1*nb*, V1*nb* is represented by the following equation (4).

$$V1nb=\{R1/(R1+R2b)\}\times V0 \quad (4)$$

On the other hand, when an abnormal condition of exhaust is sensed by at least one of the plurality of high limit switches 71, alarm unit 200 and wind pressure switch 92, series circuit C1*b* is cut off. Accordingly, assuming that voltage V1*b* on node N1 at this time is defined as V1*db*, the value of V1*db* is 0.

In other words, microcomputer 101 can determine that exhaust is normally conducted when voltage V1*b* input into terminal T2 is V1*nb*, and also can determine that an abnormal condition of exhaust has been sensed when voltage V1*b* is V1*db*.

As described above, the water heating system according to the second embodiment has the same functions and effects as those in the first embodiment. Since other configurations are the same as those in the first embodiment, the description thereof will not be repeated.

Third Embodiment

Figure 10:
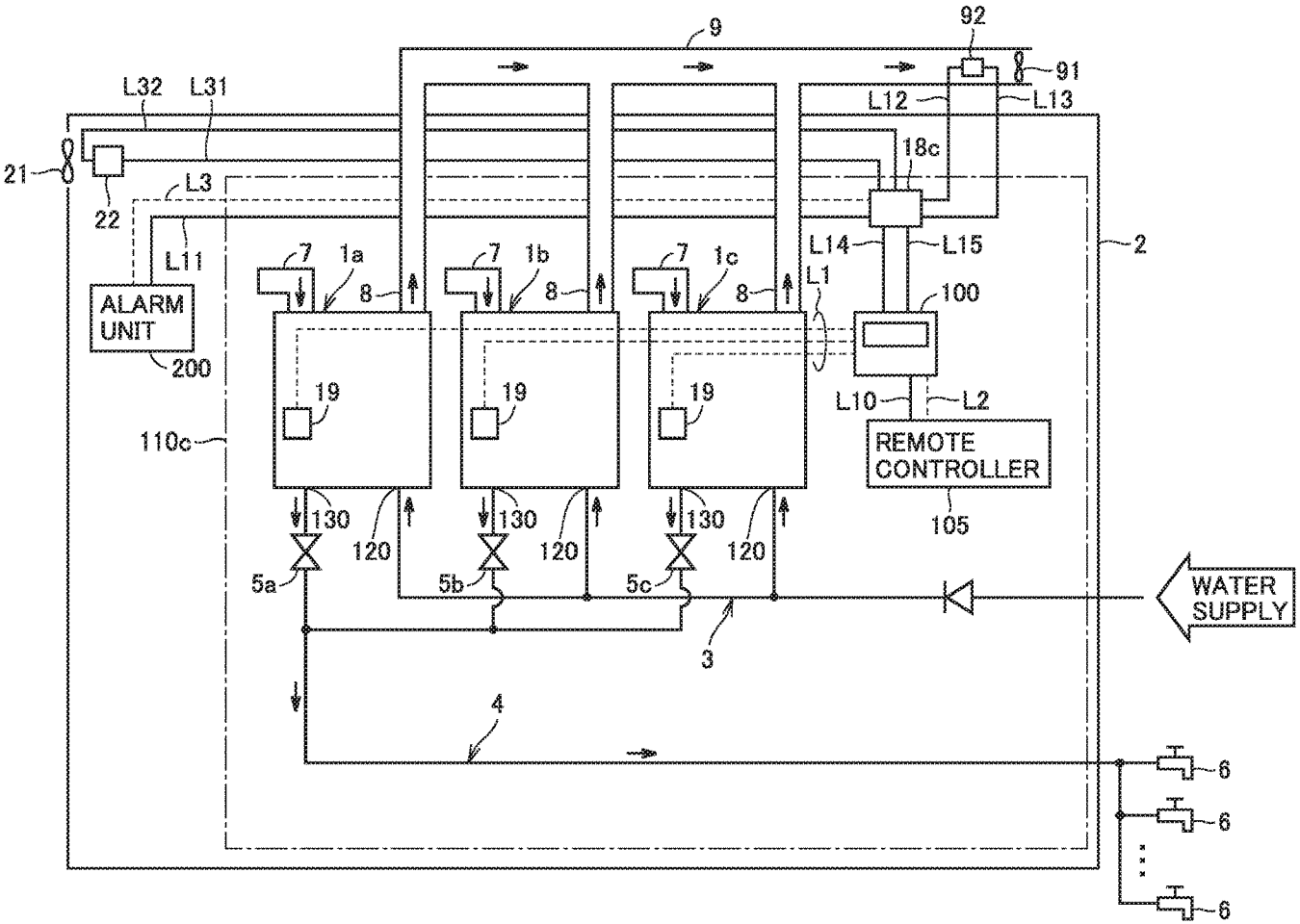
FIG. 10 is a configuration diagram of a water heating system according to the third embodiment.
Figure 11:
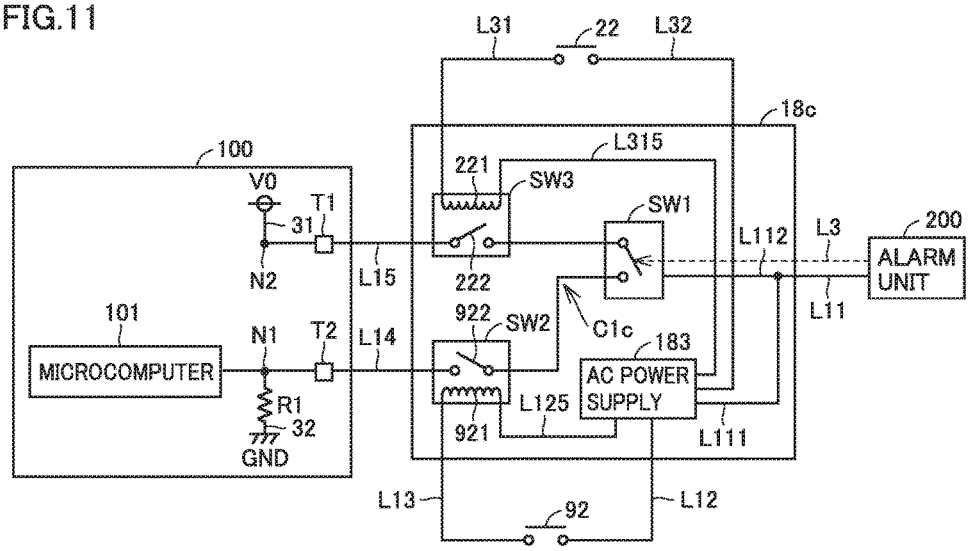
FIG. 11 is an electric circuit diagram of a sensing device according to the third embodiment.

FIGS. 10 and 11 are a configuration diagram of the water heating system according to the third embodiment, and an electric circuit diagram of the sensing device according to the third embodiment, respectively. Referring to FIGS. 10 and 11, a water heating system 110*c* and a sensing device 18*c* according to the third embodiment are different from water heating system 110 and sensing device 18 according to the first embodiment in that an air supply fan 21 is provided on the wall surface of room 2, and that wind pressure switch 22 is provided in the vicinity of air supply fan 21.

Air supply fan 21 is configured to introduce the air on the outside of room 2 into room 2. Thereby, oxygen inside room 2 that has been consumed by combustion of each water heater 1 can be supplementarily supplied. In other words, when air supplied from air supply fan 21 is insufficient, incomplete combustion occurs in each water heater 1, so that the CO concentration in the exhaust increases. In this way, the exhaust properties may deteriorate. Such deterioration of exhaust properties corresponds to one manner of an abnormal condition of exhaust.

Wind pressure switch 22 senses the wind pressure of air supplied. Wind pressure switch 22 is configured to be shifted from an electrically conducting state to an electrically non-conducting state when the wind pressure of air supplied is equal to or less than a prescribed value.

Wind pressure switch 22 is connected to a switch SW3 of sensing device 18*c* through power lines L31, L32 and L315. As shown in FIG. 11, switch SW3 includes a coil 221 and a contact 222. Switch SW3 is electrically connected in series between power supply line 31 and switch SW1, and constitutes a series circuit C1*c* together with switch SW1 and switch SW2. Wind pressure switch 22 and coil 221 of switch SW3 are connected to AC power supply 183 through power lines L31, L32 and L315, and receive electric power supplied from AC power supply 183. When wind pressure switch 22 is in a conducting state, coil 221 is excited, thereby closing contact 222. In other words, when wind pressure switch 22 is in an electrically conducting state, switch SW3 is also brought into an electrically conducting state.

On the other hand, when wind pressure switch 22 senses a decrease in wind pressure of air supplied and is shifted from an electrically conducting state to an electrically non-conducting state, a current does not flow also through coil 221. At this time, since coil 221 is not excited, contact 222 is opened. In other words, when wind pressure switch 22 is in an electrically non-conducting state, switch SW3 is also brought into an electrically non-conducting state. Switch SW3 corresponds to the "fourth sensing unit".

Accordingly, series circuit C1*c* is in a conducting state in a normal condition, so that a current can be caused to flow through the path in which series circuit C1*c* is placed. On the other hand, series circuit C1*c* is cut off when an abnormal condition of exhaust is sensed by at least one of wind pressure switch 22, alarm unit 200 and wind pressure switch 92. Thus, a current does not flow through the above-described path.

Assuming that resistance of series circuit C1*c* is defined as resistance R2*c* and voltage V1*c* on node N1 in the normal condition is defined as V1*nc*, V1*nc* is represented by the following equation (5).

$$V1nc=\{R1/(R1+R2c)\}\times V0 \quad (5)$$

On the other hand, when an abnormal condition of exhaust is sensed by at least one of wind pressure switch 22, alarm unit 200 and wind pressure switch 92, series circuit C1*c* is cut off. Thus, assuming that the value of voltage V1*c* on node N1 at this time is defined as V1*dc*, the value of V1*dc* is 0.

Accordingly, microcomputer 101 can determine that exhaust is normally conducted when voltage V1*c* input into terminal T2 is V1*nc*. On the other hand, when voltage V1*c* is V1*dc*, microcomputer 101 can determine that an abnormal condition of exhaust has been sensed.

As described above, the water heating system according to the third embodiment has the same functions and effects as those in the first embodiment. Since other configurations are the same as those in the first embodiment, the description thereof will not be repeated.

Furthermore, the third embodiment provides a configuration in which, in addition to alarm unit 200 and wind pressure switch 92 in the first embodiment, wind pressure switch 22 is further provided as a sensing element for sensing an abnormal condition of air supply or exhaust. However, there may be a configuration in which wind pressure switch 22 is further provided in addition to alarm unit 200, wind pressure switch 92 and a plurality of high limit switches 71 in the second embodiment. Furthermore, the sensing element for sensing an abnormal condition of air supply or exhaust is not limited to four types elements described in the first to third embodiments, but may be a wind speed switch and the like, for example.

In addition, the present invention can be applicable to a so-called simplified two-unit-linked water heating system in which two water heaters are linked in parallel. In the simplified two-unit-linked water heating system, a hot water supply control unit 19 of one water heater 1 also serves as a controller that collectively controls two water heaters 1. One water heater 1 including hot water supply control unit 19 serving as the controller as described above is referred to as a "master water heater" and the other water heater 1 is also referred to as a "slave water heater". Also for such a simplified two-unit-linked water heating system, a so-called common vent-type in which exhaust ducts of water heaters are connected to an exhaust duct assembly is known.

In a simplified two-unit-linked system of a common vent-type, generally, hot water supply control unit 19 of the master water heater is provided with signal input units (terminal blocks) corresponding to sensing elements. Accordingly, there have been concerns that the number of components in hot water supply control unit 19 is increased, and also there exists a signal input unit that is not used depending on the site, thereby producing waste.

Thus, the present invention is applied to achieve a configuration in which a plurality of sensing units are electrically connected in series to sense an abnormal condition about air supply or exhaust based on the voltage on the node between a series circuit of the plurality of sensing units and a resistance element. Thereby, the outputs from the plurality of sensing units can be monitored by one signal input unit in hot water supply control unit 19 of the master water heater. In other words, the outputs from a plurality of sensing units for sensing an abnormal condition of air supply or exhaust can be monitored in a simple configuration.

In some of common vent-type water heating systems, a check valve for preventing a backflow of exhaust is provided in an exhaust duct of each water heater. If the check valve fails, however, a controller may not be able to sense the failure. Even in such a case, according to the water heating system in each of the present first to third embodiments, since the sensing device can sense an abnormal condition of air supply or exhaust, the operation of the system can be continued as long as possible while safety is ensured.

Although the embodiments of the present invention have been described as above, it should be understood that the embodiments disclosed herein are illustrative and non-restrictive in every respect. The scope of the present invention is defined by the terms of the claims, and is intended to include any modifications within the meaning and scope equivalent to the terms of the claims.

What is claimed is:

1. A water heating system of a combustion heating type of a forced exhaust mode, the water heating system comprising:

a plurality of water heaters connected in parallel with respect to a hot water supply path, the plurality of water heaters each having an exhaust path connected to an exhaust path assembly;

a controller configured to collectively control the plurality of water heaters; and a plurality of sensing units, each of the plurality of sensing units being configured to be shifted from an electrically conducting state to an electrically non-conducting state when each of the plurality of sensing units senses an abnormal condition about air supply or exhaust, the plurality of sensing units being electrically connected in series between a power supply line and a ground line, a series circuit of the plurality of sensing units being electrically connected in series to a resistance element between the power supply line and the ground line, the controller being configured to monitor the abnormal condition about air supply or exhaust based on a voltage on a node between the series circuit and the resistance element.

2. The water heating system according to claim 1, wherein a CO alarm unit is installed in an indoor space in which the plurality of water heaters are housed, and the CO alarm unit is configured to output an alarm based on the sensed CO concentration in the indoor space, the plurality of sensing units include a first sensing unit and a second sensing unit, the first sensing unit is configured to receive from the CO alarm unit a signal showing that the CO alarm unit has sensed CO, and the second sensing unit is configured to receive an output from a first wind pressure switch for sensing a decrease in wind pressure inside the exhaust path assembly.

3. The water heating system according to claim 2, wherein the plurality of sensing units further include a third sensing unit, and the third sensing unit is a high limit switch configured to sense an abnormal temperature inside an air supply path of each of the plurality of water heaters.

4. The water heating system according to claim 2, wherein the plurality of sensing units further include a fourth sensing unit, and the fourth sensing unit is configured to receive an output from a second wind pressure switch for sensing wind pressure of air supplied into the indoor space in which the plurality of water heaters are housed.

5. The water heating system according to claim 3, wherein the plurality of sensing units further include a fourth sensing unit, and the fourth sensing unit is configured to receive an output from a second wind pressure switch for sensing wind pressure of air supplied into the indoor space in which the plurality of water heaters are housed.

* * * * *